United States Patent [19]

Blitzer

[11] Patent Number: 5,068,936

[45] Date of Patent: Dec. 3, 1991

[54] DISPOSABLE ARTICLE OF BEDDING

[76] Inventor: Gene Blitzer, 96 High Dr., P.O. Box 114, Monroe, Conn. 06468

[21] Appl. No.: 472,729

[22] Filed: Jan. 29, 1990

Related U.S. Application Data

[63] Continuation of Ser. No. 892,202, Aug. 4, 1986, abandoned.

[51] Int. Cl.[5] ..... A47G 9/04; B32B 23/02

[52] U.S. Cl. ..... 5/487; 5/490; 5/496; 428/192; 428/194; 428/195; 428/290; 428/343

[58] Field of Search ..... 5/487, 490, 495–500; 297/220; 428/192, 194, 195, 198, 290, 343

[56] References Cited

U.S. PATENT DOCUMENTS

| | | | |
|---|---|---|---|
| 2,510,120 | 6/1950 | Leander | 428/343 X |
| 2,721,810 | 10/1955 | Schram | 428/195 X |
| 2,884,652 | 5/1959 | Paolicelli | 5/487 |
| 3,156,581 | 11/1964 | Finnegan et al. | 428/343 |
| 3,620,366 | 11/1971 | Parkinson et al. | 428/343 X |
| 3,645,835 | 2/1972 | Hodgson | 428/195 |
| 3,654,059 | 4/1972 | Zisblatt | 5/487 X |
| 3,665,918 | 5/1972 | Lindquist et al. | 428/194 X |
| 4,097,943 | 7/1978 | O'Connell | 5/484 |

FOREIGN PATENT DOCUMENTS

| | | | |
|---|---|---|---|
| 80/01920 | 9/1980 | World Int. Prop. O. | 5/487 |

*Primary Examiner*—Michael F. Trettel
*Attorney, Agent, or Firm*—CTC & Associates

[57] ABSTRACT

A disposable article of bedding comprises a piece of non-woven foldable material which when flat is generally rectangular. A coating of mildly sticky material is adhered to one side only of the piece of material and may occupy the entirety or a portion only of the side to which it is adhered. In either event, the coating may be solid or in pattern form. A continuous method of making disposable articles of bedding comprises the steps of moving a web of non-woven material past a work station, and applying a coating of mildly sticky material to one surface only of the web at the work station.

1 Claim, 2 Drawing Sheets

DISPOSABLE ARTICLE OF BEDDING

This is a continuation of application Ser. No. 892,202, filed 08/04/86, now abandoned.

BACKGROUND OF THE INVENTION

This invention relates to disposable articles of bedding, such as sheets and pillow cases, and to a method of making the same.

For many years, attempts to produce satisfactory disposable bedding have been unsuccessful. The problem, which so far has defied solution, is that disposable fabrics are too slippery to stay in place in normal use.

Hrubecky et al. U.S. Pat. No. 3,321,782, which issued May 30, 1967 to Kimberly-Clark Corporation, on an application filed Feb. 23, 1966, discloses bottom and top sheets of disposable flexible materials, such as laminated cellulose wadding, scrim reinforced creped tissue, non-woven webs, plastic film reinforced paper, and various types of plastic film, etc. Lines of adhesive are applied to opposite corners of one end of the sheet, when intended as a top sheet and to all four corners when intended as a bottom sheet. Thus, the sheets, both top and bottom, are provided with fitted corners.

Zisblatt U.S. Pat. No. 3,654,059, which issued Apr. 4, 1972, on an application filed Sept. 15, 1969, discloses a disposable mattress cover 22 which is fitted partially around a mattress 21 and a disposable sheet 32 which is fitted partially around mattress cover 22. Mattress cover 22 is provided with adhesive strips 24 and sheet 32 is provided with adhesive strips 34. Adhesive strips 24 and 34 are covered with backing strips which are removed prior to use of cover 22 and sheet 32. Adhesive strips 24 secure the edges and ends of cover 22 to the sides and ends of mattress 21 and adhesive strips 34 secure the sides and one end of sheet 32 to cover 22, in such a way that if the adhesive strips do what they are supposed to do, either the bed must be made with a person in it, or else the person must be a contortionist to get into the bed, a condition which is hardly conducive to hospital use. Examples and properties of the material of the adhesive strips are given. Such material is described as "normally tacky" (column 6, line 32). It is highly doubtful that hospital personnel would bother to remove the backing strips.

Palenski et al. U.S. Pat. No. 3,681,795, which issued Aug. 8, 1972 to Kimberly-Clark Corporation, on an application filed Nov. 9, 1970, is yet another attempt to solve the disposable bed sheet problem, in this instance by providing a combination contoured disposable sheet comprising a top and bottom sheet combined to form a one-piece disposable sheet.

Davis U.S. Pat. No. 3,859,678, which issued Jan. 14, 1975, on an application filed Oct. 9, 1973, relates to a disposable bed covering which may be handled as a unit. This patent does not appear to address the slipperiness problem but instead is concerned with making the material porous to permit moisture to pass therethrough as an aid in preventing bed sores.

Hammond U.S. Pat. No. 4,461,049, which issued July 24, 1984 to Kimberly-Clark Corporation, on an application filed Apr. 12, 1982, discloses disposable fitted sheets having elastic bands which assist in maintaining proper fit. Additionally, the Hammond patent recognizes that the problem occasioned by the slipperiness of disposable materials persists. At Column 1, lines 51–57, the problem is summarized as follows: "Corner pockets are readily formed in sheets of tissue or non-woven polymers by well known methods, which may vary with the particular materials. Unfortunately, these materials, especially the polymers, tend to be slippery when used as bed sheets. Even with pockets formed in the four corners, the sheets tend to slide out of position during use."

It is an important object of the invention to provide disposable articles of bedding, such as sheets and pillow cases, which overcome the slipperiness problem which has for years plagued all efforts to solve the same.

It is a further important object to provide disposable articles of bedding which are price competitive.

It is an additional object to provide disposable articles of bedding which are simple to use and are not subject to misapplication.

It is another object to provide disposable articles of bedding which are easily manufactured.

It is a still further object to provide disposable bedding comprising identical and separate top and bottom sheets.

Yet a further object is to provide disposable bed sheets which, while making use of a coating of mildly sticky material, do not require that a removable backing strip be placed thereover, and which sheets can be stored in folded up or rolled condition prior to use and yet can be easily handled prior to use without sticking to themselves or other objects.

It is yet an additional object to provide disposable pillow cases each of which is open at both ends.

It is also an important object to provide an economical and simple method of manufacturing disposable articles of bedding embodying the invention.

The foregoing and other objects and advantages will appear hereinafter.

SUMMARY OF THE INVENTION

Briefly, in its article aspect, the invention presents disposable articles of bedding each comprising a piece of non-woven foldable material which when flat is generally rectangular and which has a coating of mildly sticky material adhered to one side only of the piece of material. The coating may occupy the entirety or a portion only of the side to which it is adhered. In either event, the coating may be solid or in pattern form. The mildly sticky material is such that no removable backing strip or release agent is required, i.e., the mildly sticky material is such that it will not interfere with unfolding or unrolling a sheet or with making a bed with one or more such sheets.

In its method aspect, the invention comprises the steps of continuously moving a web of non-woven material past a work station, and continuously applying a coating of mildly sticky material to one surface only of the web at the work station.

DESCRIPTION OF THE INVENTION

The invention will be described first by reference to FIGS. 1, 2 and 3 which show a bed sheet 10 comprising a piece of foldable disposable material which is generally rectangular when it is flat as shown.

The piece of material has first and second surfaces 12 and 14, respectively, as well as parallel side edges 16 and 18 and parallel end edges 20 and 22 which are perpendicular to side edges 16 and 18.

The foldable material is non-woven as is common with disposable fabrics. Examples of such non-woven materials are paper tissue and webs of synthetic polymers such as polypropylene, polyethylene, polyamide, polyester, polyurethane, trans-1,2-polybutadiene, trans-polyisoprene and the like. These materials are comfortable, easy to use and commercially available in rolls suitable for continuous methods of manufacture.

Figure 1:
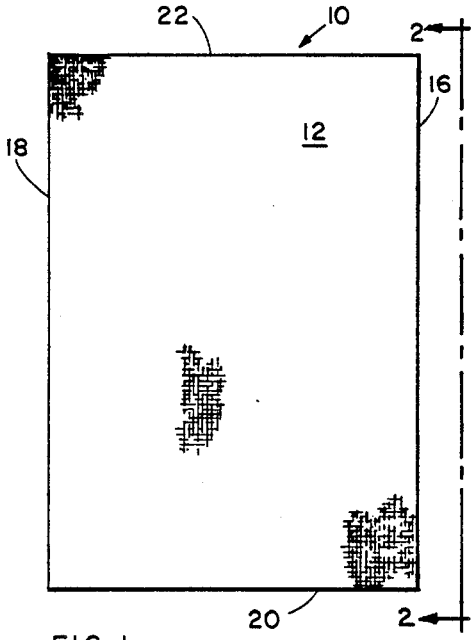
FIG. 1 is a plan view of a first side of a preferred disposable article of bedding in the form of a sheet embodying the invention, the sheet being shown in flat condition.
Figure 2:
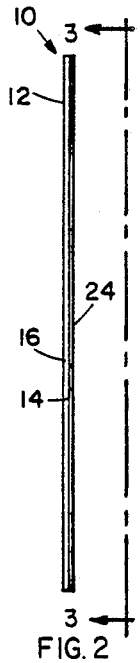
FIG. 2 is a view taken on line 2—2 of FIG. 1.
Figure 3:
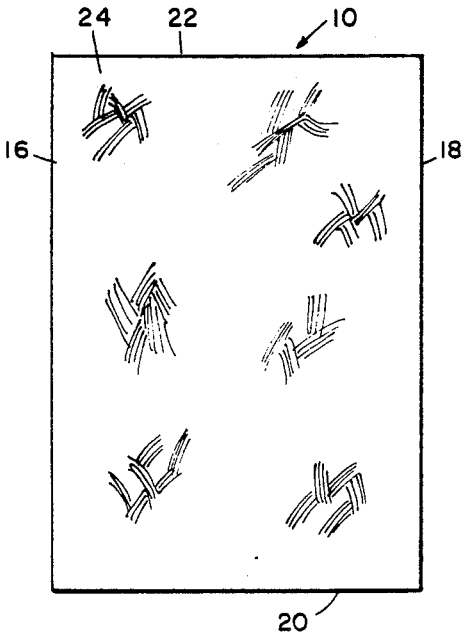
FIG. 3 is a view taken on line 3—3 of FIG. 2, being a plan view of a second side of the sheet of FIG. 1.

A coating 24 of mildly sticky material is adhered to second surface 14 and in the embodiment of FIGS. 1, 2 and 3 covers the entirety of surface 14.

However, the mildly sticky material need not occupy the entirety of surface 14. In fact, it preferably occupies less than the entirety of surface 14.

Figure 5:
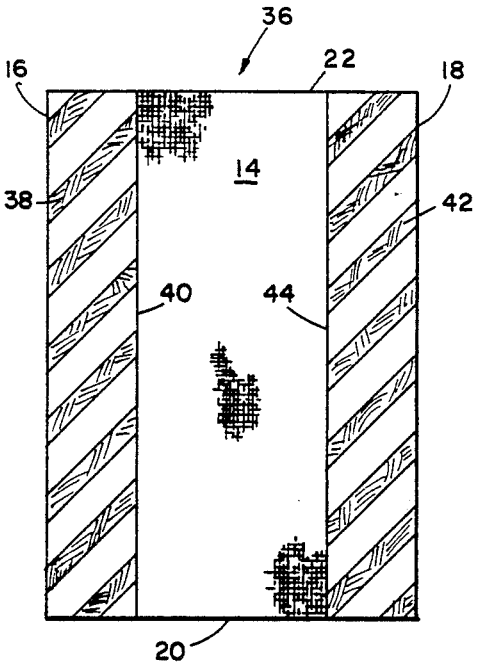
FIG. 5 is a view similar to FIG. 3 but showing a plan view of the second side of a third preferred sheet embodying the invention.
Figure 4:
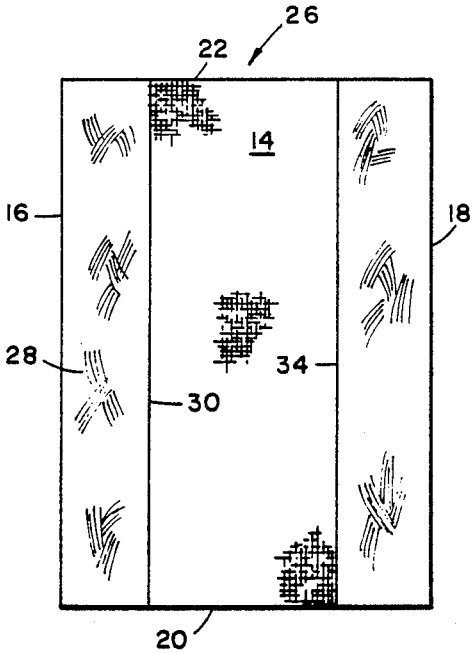
FIG. 4 is view similar to FIG. 3 but showing a plan view of a second side of a second preferred sheet embodying the invention.

Thus, in each of the embodiments of FIGS. 4 and 5, the coating is localized in each of two generally rectangular areas of surface 14.

FIG. 4 shows a sheet 26 in which surface 14 has a coating 28 of mildly sticky material adhered to surface 14 and occupying the entirety of a localized generally rectangular area bounded by side edge 16 and end edges 20 and 22. Coating 28 is also bounded by a line 30 parallel to side edge 16 and spaced therefrom a distance less than half the distance from side edge 16 to side edge 18. Sheet 26 also has an additional coating of mildly sticky material adhered to surface 14 and occupying the entirety of a localized generally rectangular area bounded by side edge 18 and end edges 20 and 22 and by a line 34 parallel to side edge 18 and spaced therefrom a distance less than half the distance from side edge 18 to side edge 16. The width of coating 28 is as shown the same as the width of the additional coating.

FIG. 5 shows a sheet 36 in which surface 14 has a coating 38 of mildly sticky material adhered to surface 14 and occupying less than the entirety of a localized generally rectangular area bounded by side edge 16 and end edges 20 and 22. Coating 28 is also bounded by a line 40 parallel to side edge 16 and spaced therefrom a distance less than half the distance from side edge 16 to side edge 18. Sheet 36 also has a coating 42 of mildly sticky adhesive material adhered to surface 14 and occupying less than the entirety of a localized generally rectangular area bounded by side edge 18 and end edges 20 and 22. Coating 42 is also bounded by a line 44 parallel to side edge 18 and spaced therefrom a distance less than half the distance from side edge 18 to side edge 16. The width of coating 42 is as shown the same as the width of coating 38.

As shown, coatings 38 and 42 are patterned, being in the form of parallel spaced stripes making an angle of about 45 degrees with edges 16, 18, 20, and 22.

Other patterns, such as dots and stripes at other angles are also possible. Furthermore, while coating 24, as shown in FIG. 3, occupies the entirety of surface 14, it, too, may be patterned.

In any event, sheets 10, 26 and 36 are non-fitted and are interchangeable as bottom and top sheets. Sheets 10, 26 and 36 are also interchangeable end for end.

That sheet which is to be the bottom sheet is applied to a mattress in the usual manner with coated side 14 facing downwardly, so that when the sheet is tucked in, the adhesive material will stick to a mattress or a mattress cover so that the bottom sheet will not slip out of desired position.

That sheet which is to be the top sheet is then applied in the usual manner over the already in place bottom sheet with coated side 14 facing upwardly, so that when the sheet is tucked in, the adhesive material will stick to the bottom sheet and/or other bedding such as blankets, so that the top sheet will not slip out of position.

The coatings will not come in contact with the occupant of the bed.

Sheets embodying the invention may be supplied prefolded or in a continuous web wound on a roller, with perforations between sheets on the web.

Figure 6:
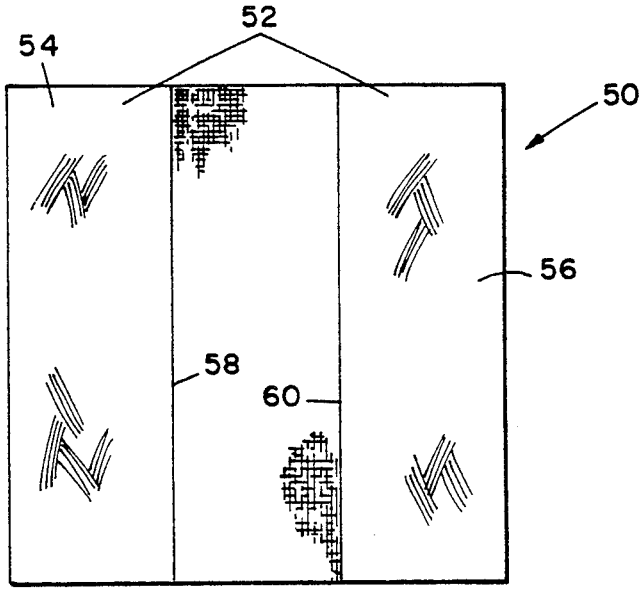
FIG. 6 is a plan view of one side of a blank from which a preferred disposable pillow case in accordance with the invention can be made.

FIG. 6 is a plan view of the second side of a blank 50 from which a preferred pillow case 62 in accordance with the invention can be made. Blank 50 is a rectangular piece of non-woven foldable disposable material. The first side of the piece of material is plain and the second side has a coating 52 of mildly sticky material adhered thereto. Coating 52 has first and second like portions 54 and 56. Portion 54 is bounded by the end edges of blank 50 and one longitudinal edge of blank 50. Portion 56 is bounded by the end edges of blank 50 and the other longitudinal edge of blank 50". The width of each of portions 54 and 56 is about one-third of the distance between the longitudinal edges of blank 50.

The edges of portions 54 and 56 remote from the longitudinal edges are parallel to each other and may be considered to be fold lines 58 and 60, respectively, about which blank 50 is folded so as to place coating portion 56 in overlapping engagement with the first side of the piece of material, with coating portion 54 not overlapping the first side of the piece of material.

Figure 7:
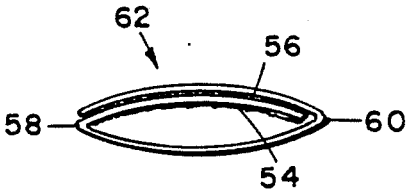
FIG. 7 is an end view of a pillow case made from the blank of FIG. 6.

The result is a pillow case 62 (FIG. 7) open at both ends. Pillow case 62 is held together by the overlapping engagement of coating portion 56 with the first side of the piece of material, but coating portion 56 will engage a pillow (not shown) inserted in case 62 to keep the pillow from slipping out of case 62.

Figure 8:
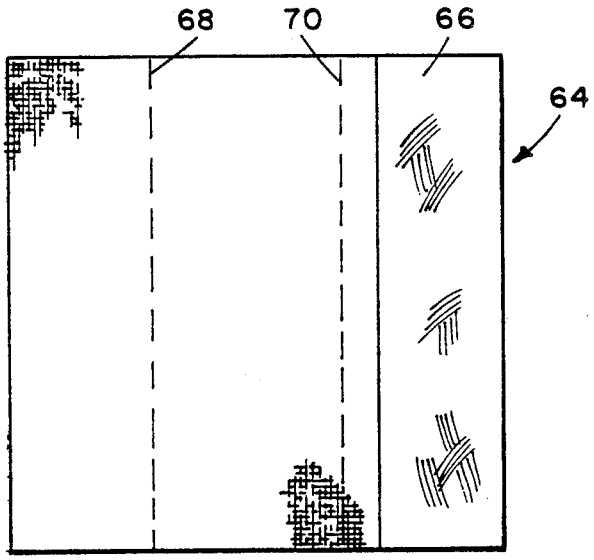
FIG. 8 is a plan view of one side of a blank from which another preferred disposable pillow case in accordance with the invention can be made.

FIG. 8 is a plan view of the second side of a blank 64 from which another preferred pillow case in accordance with the invention can be made. Blank 64 is a rectangular piece of non-woven foldable disposable material. The first side of the piece of material is plain and the second side has a coating 66 of mildly sticky material adhered thereto.

Coating 66 is limited to a rectangular area bounded by the end edges of blank 64 and one longitudinal edge of blank 64.

Blank 64 is folded about lines 68 and 70 that are parallel to the longitudinal edges of the piece of material to place a first portion of coating 66 in overlapping engagement with the first side of the piece of material with a second portion of coating 66 not in overlapping relationship with the first side of the piece of material.

Figure 9:
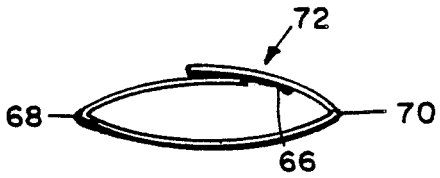
FIG. 9 is an end view of a pillow case made from the blank of FIG. 8.

The result is a pillow case 72 (FIG. 9) open at both ends. Pillow case 72 is held together by the overlapping engagement of the first portion of coating 66 with the first side of the piece of material. The second portion of coating 66 will engage a pillow (not shown) inserted in case 72 to keep the pillow from slipping out of case 72.

As used herein, the term "mildly sticky material" means a material which is sticky enough so that a sheet having a coating thereof will not be subject to slipperiness problems, and yet which is not so sticky as to be subject to handling problems, even though no removable backing strip or release agent is used.

The mildly sticky material must not be toxic and must be cheap and easily applied and must not lose its efficacy with the passage of time.

Furthermore, the mildly sticky material must be visible, to enable hospital personnel to place the sheets proper side down or up.

Examples of suitable materials which by themselves may be mildly sticky or may be compounded to such a mildly sticky state include low molecular weight or depolymerized forms of natural rubber, cis-polyisoprene, polybutadienes, poly-(butadiene-styrene), ethylene-propylene-diene terpolymers, polyurethanes, polyalpha-olefins or mixtures thereof, also high molecular weight polymers extended with such low molecular polymers or with plasticizers, oils, tackifiers or waxes or a combination of such extending materials; waxes by themselves with or without microcrystallinity have been found very useful for the purpose of this invention.

Disposable articles of bedding in accordance with the invention can be made by the continuous method of moving a web of non-woven material past a work station and applying a coating of mildly sticky material to one surface only of the web at the work station. The web may conveniently be unrolled from a first roller and wound on a second roller after the web passes the work station. The applying step may be performed by brushing or spraying.

The method may include the further step of transversely perforating the web at spaced intervals to define individual sheets which may be separated from the web.

It is apparent that the invention attains the stated objects and advantages over others.

The disclosed details are exemplary only and are not to be taken as limitations on the invention except as those details are included in the appended claims.

What is claimed is:

1. A disposable article of bedding comprising a piece of non-woven foldable material which when flat is generally rectangular and having first and second surfaces, first and second side edges and first and second end edges and a coating of mildly sticky material deposited on and adhered only to said second surface, wherein a portion of said second surface is in overlapping engagement with a portion of said first surface and is held in such engagement by a first portion of said coating which engages said first surface, and an additional portion of said coating is not in overlapping engagement with said first surface, and said article is a pillow case open at both ends, and wherein said coating is limited to first and second rectangular areas of said second surface adjacent opposite edges thereof.

* * * * *